US005951385A

United States Patent [19]

Newhouse et al.

[11] Patent Number: 5,951,385

[45] Date of Patent: Sep. 14, 1999

[54] DRILL BIT CASE AND DRILL SHARPENER PACKAGE

[75] Inventors: Debbie A. Newhouse, Prospect, Ky.; Holeung E. Tse, Mission, Kans.

[73] Assignee: Credo Tool Company, Woodburn, Oreg.

[21] Appl. No.: 08/900,677

[22] Filed: Jul. 25, 1997

Related U.S. Application Data

[60] Provisional application No. 60/023,370, Aug. 8, 1996.

[51] Int. Cl.[6] ..... B24B 23/00; B24B 27/08

[52] U.S. Cl. ..... 451/358; 451/358; 451/349; 451/344; 206/379; 206/372; 206/373

[58] Field of Search ..... 451/349, 358, 451/344, 415; 206/379, 372, 373, 374

[56] References Cited

U.S. PATENT DOCUMENTS

| | | | |
|---|---|---|---|
| 2,589,593 | 3/1952 | Anderson et al. | 206/46 |
| 3,599,302 | 8/1971 | Dudek | 29/36 |
| 5,251,407 | 10/1993 | Afshar | 451/349 |

*Primary Examiner*—David A. Scherbel
*Assistant Examiner*—Shantese McDonald
*Attorney, Agent, or Firm*—Polster, Lieder, Woodruff & Lucchesi, L.c.

[57] ABSTRACT

A drill bit and sharpener package includes a case having two leaves pivotally mounted together along one edge by ring-shaped knuckles; a tube mounted within the compass of the knuckles and serving as a pintle about which said knuckles rotate, and a drill bit sharpener removably and replaceably mounted in the tube.

13 Claims, 8 Drawing Sheets

9F
9I
9H
9G
59
57
54
75
53
56
58
33
32
31
30

10F
10H
10G
75

38
39
40
37
43
42
41

12

30
23

DRILL BIT CASE AND DRILL SHARPENER PACKAGE

CROSS-REFERENCE TO RELATED APPLICATIONS

This application claims the benefit of U.S. Provisional Application No. 60/023,370, filed Aug. 8, 1996.

STATEMENT REGARDING FEDERALLY SPONSORED RESEARCH OR DEVELOPMENT

Not Applicable.

BACKGROUND OF THE INVENTION

Drill sharpeners for sharpening twist drills, have been known and described heretofore. Most of them involve the use of conventional grinding wheels, as shown, for example in FIG. 1 of U.S. Pat. No. 4,485,596 and in U.S. Pat. Nos. 4,401,975 and 4,471,481. A somewhat more compact sharpener is shown in British application 2186512, published Aug. 19, 1987, but none of the prior art devices is adapted to be packaged with a drill case.

One of the objects of this invention is to provide a drill case and drill sharpener package that is attractive and convenient.

Other objects will become apparent to those skilled in the art in the light of the following description and accompanying drawings.

BRIEF SUMMARY OF THE INVENTION

In accordance with this invention, generally stated, a drill bit and sharpener package is provided which includes a case having two leaves pivotally mounted together along one edge by ring-shaped knuckles, a tube, mounted within the compass of the knuckles and serving as a pintle about which the knuckles rotate, and a drill bit sharpener removably and replaceably mounted in the tube. Preferably, the case contains at least one drill-receiving tray mounted in one at least one of the leaves for pivoting about a lower pivot point to permit easy access to the drills.

Also, in the preferred embodiment, a drill-receiving tray has a chuck wrench seat in it, in which a Jacobs type chuck wrench can be mounted. The drill bit sharpener has a shaft projecting from a drill bit sharpener housing in a direction axially within the tube.

In the preferred embodiment, a hinge cap is mounted in an open end of the tube, the hinge cap having a depending central stem with a blind bore opening at its upper end through the top of the hinge cap for receiving the shaft that projects from the sharpener housing.

In the preferred embodiment, each of the leaves of the case has side walls extending around its perimeter, the side walls of the two leaves facing each other and abutting when the leaves are closed, one of the leaves having a projecting latch arm with a lip at an outer end and the other of the leaves' walls having a lip-receiving recess complementarily positioned to receive the lip. The sharpener has a housing shaped complementarily to the section of the "spine" of the case between the tube and an upper edge of the case, and a wire stand member having an arcuate section extending into a space between the hinge cap and the body of the sharpener housing and a pair of legs extending from the arcuate section axially of the housing and pivotally mounted to the housing at ends of the legs at a remove from the arcuate section when the sharpener is mounted in the tube. The arcuate section is rotatable to a position in which it supports an end of the sharpener housing when the shaft is connected to an electric drill. The sharpener contains a grinding wheel concentric with and mounted on the shaft, bearings for the shaft, and an opening defined by a collar which receives a collet-holding chuck rotatably. A drill, held in a collet in the chuck, is positioned to engage the grinding wheel at an appropriate angle, and to be rotated with the collet in the collar.

DETAILED DESCRIPTION OF THE INVENTION

Figure 1:
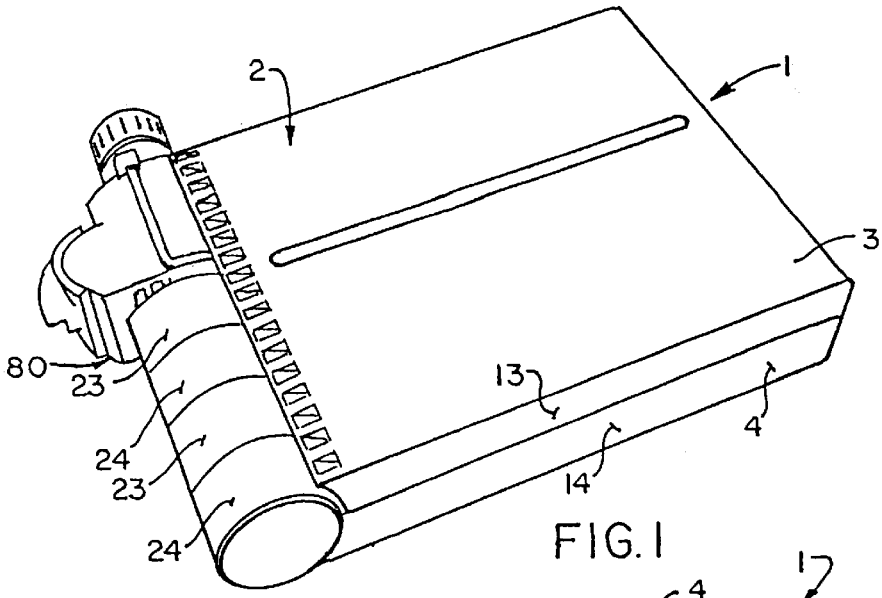
FIG. 1 is a view in perspective of one embodiment of the package of this invention, with a closed case and a drill sharpener mounted in the spine of the case.

Referring now to the figures for one illustrative embodiment of the package of this invention, reference numeral 1 indicates the complete package. The package 1 includes a case 2, with a right leaf 3 and a left leaf 4.

Figure 2:
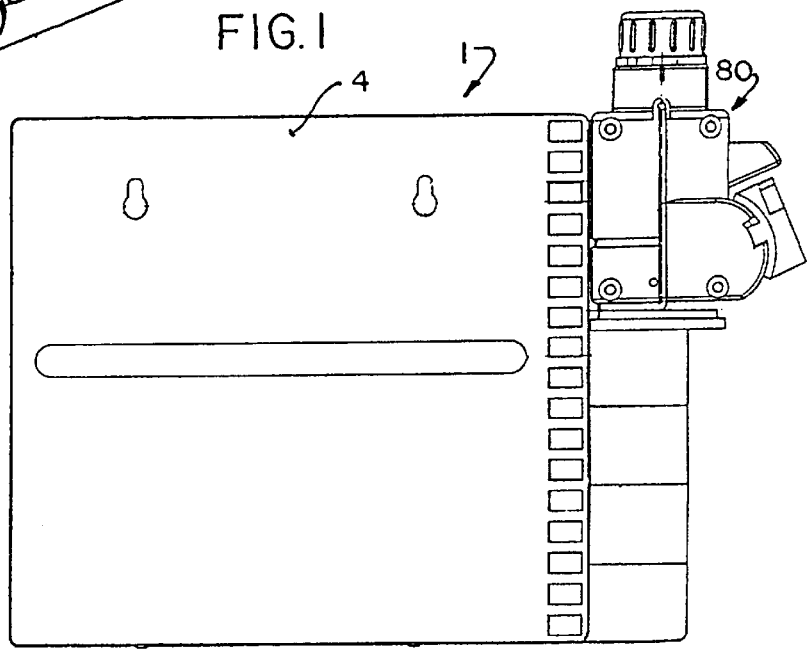
FIG. 2 is a view in rear elevation of the case shown in FIG. 1.
Figure 3:
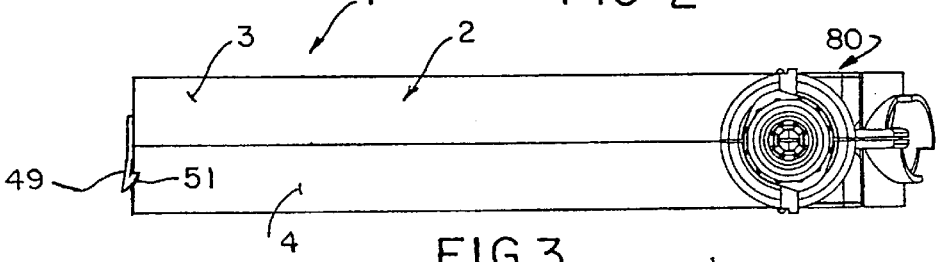
FIG. 3 is a top plan view.
Figure 4:
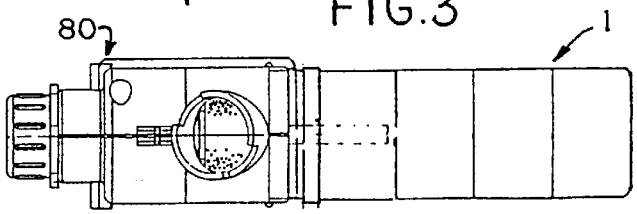
FIG. 4 is a view in end elevation.
Figure 5:
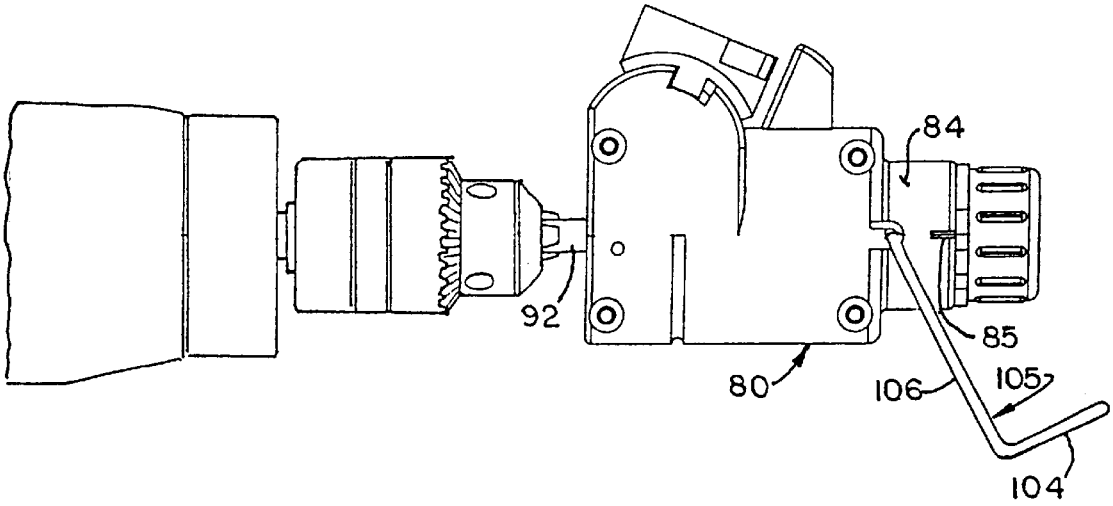
FIG. 5 is a view in side elevation, partly fragmentary, showing an electric drill connected to a shaft of the drill sharpener of FIGS. 1–4 dismounted from the case.
Figure 8A:
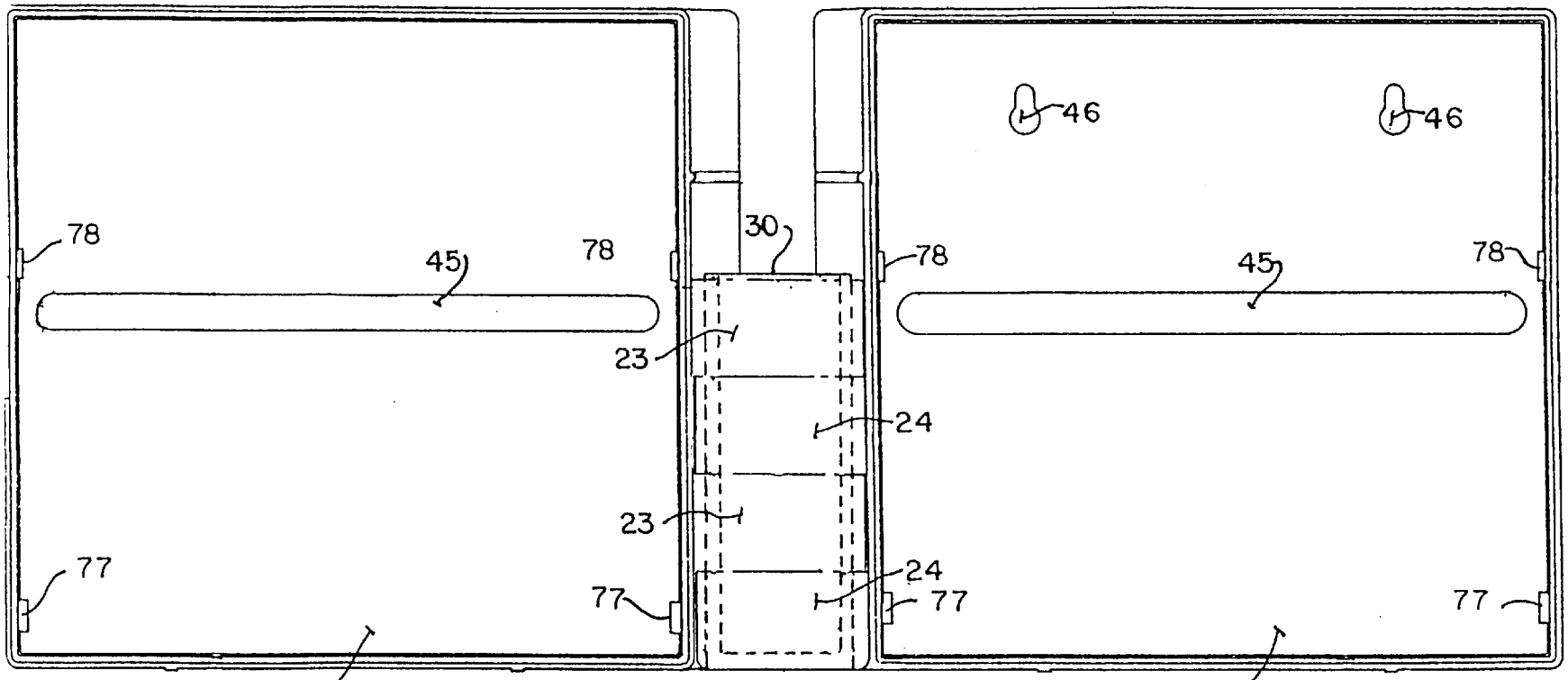
FIG. 8A is a view of the drill bit case in open position, showing the interior of the case without drill trays.
Figure 8B:
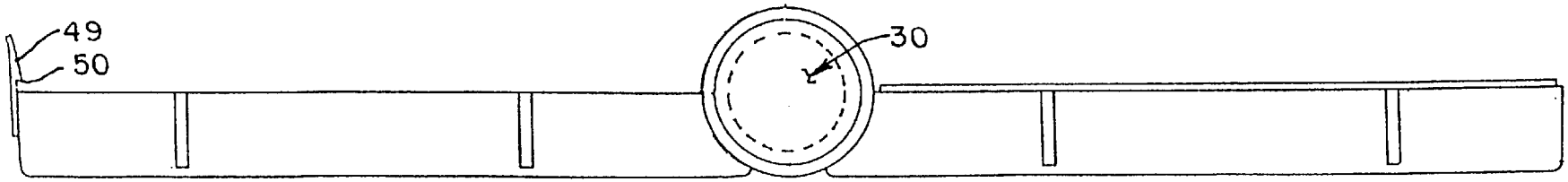
FIG. 8B is a bottom plan view of the case shown in FIG. 8A.
Figures 8E, 8F, 9A, 9B, 9C, 9D, 9E, 9F, 9G, 9H, 9I:
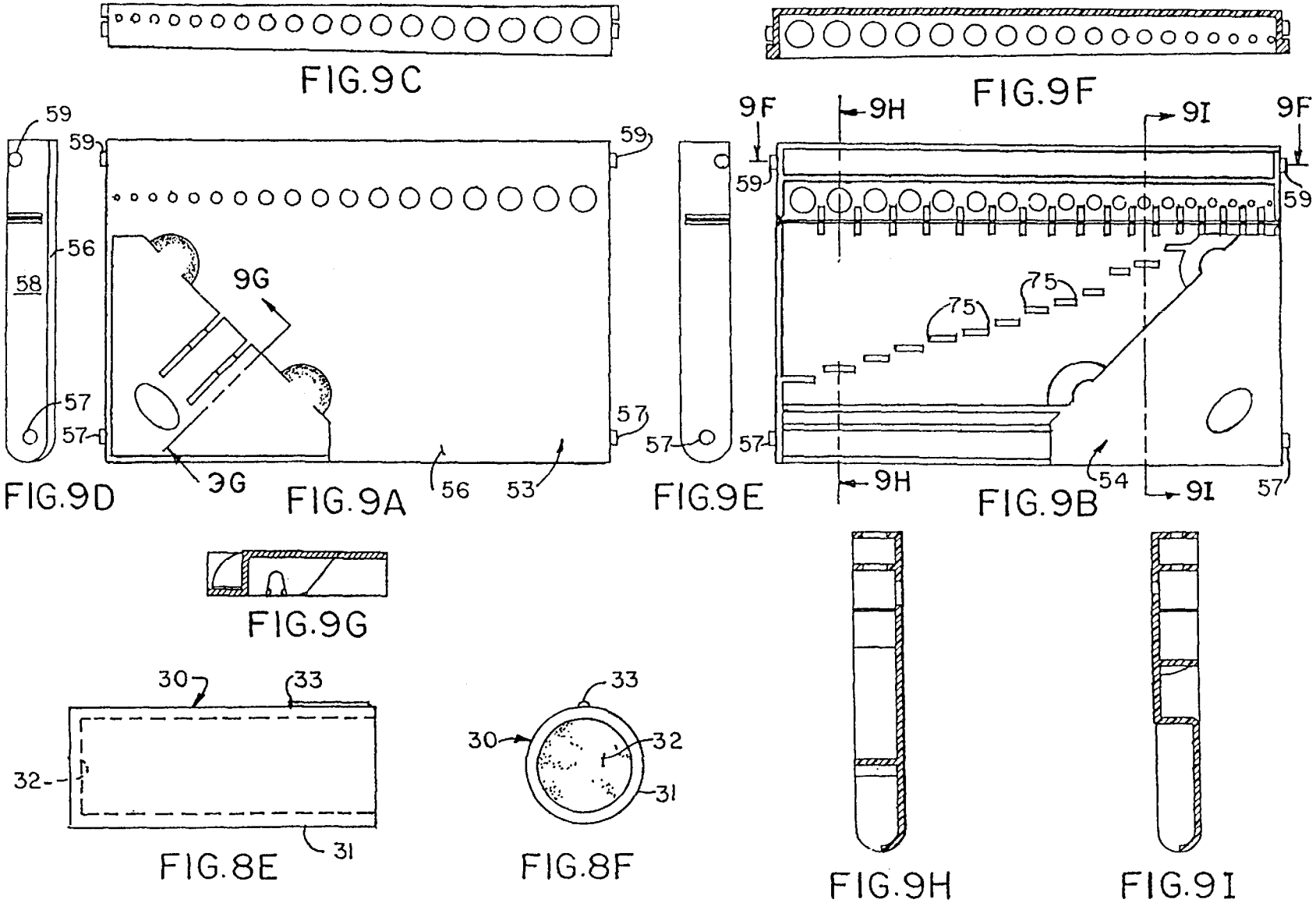
FIG. 8E is a view in side elevation of a tube that is mounted in the knuckles of the case and serves as a pintle.
FIG. 8F is a top plan view of the tube shown in FIG. 8E.
FIG. 9A is a view in rear elevation of a drill-holding tray to be installed in the left leaf of the case.
FIG. 9B is a view in front elevation of a drill-holding tray to be installed in the right leaf of the case.
FIG. 9C is a top plan view of the tray shown in FIG. 9A.
FIG. 9D is a view in end elevation of the tray shown in FIG. 9A.
FIG. 9E is a view in end elevation of the tray shown in FIG. 9D.
FIG. 9F is a sectional view taken along the line 9F—9F FIG. 9B.
FIG. 9G is a sectional view taken along the line 9G—9G of FIG. 9A.
FIG. 9H is a sectional view taken along the line 9H—9H of FIG. 9B.
FIG. 9I is a sectional view taken along the line 9I—9I of FIG. 9B.

The right leaf 3 has a rim or side wall 13 around it, extending toward and abutting a side wall or rim 14 of the leaf 4 when the case is in closed position as shown in FIGS. 1 and 2. The left leaf 4 has a rim or side wall 14 around it, extending toward and abutting the side wall or rim 13 of the leaf 3 when the case is in closed position as shown in FIGS. 1 and 2. The side wall 14 has a "spine" area, with which spaced ring-shaped knuckles 24 are integral, as shown in FIGS. 1, 2 and 8A. The side wall 13 has a "spine" area, with which spaced ring-shaped knuckles 23 are integral, as shown in FIGS. 1, 2 and 8A. A deep cup in the form of a tube 30 shown in FIG. 8E, with a side wall 31 and a bottom wall 32, is sized to fit closely within the cavity defined by the rings 23 and 24, to serve as a pintle about which the knuckles 23 and 24 rotate. The cup or tube 30 has an axially extending rib 33 that provides an interference fit with the upper of the knuckles 23.

Figures 10A, 10B, 10C, 10D, 10E, 10F, 10G, 10H, 11, 12, 13, 14:
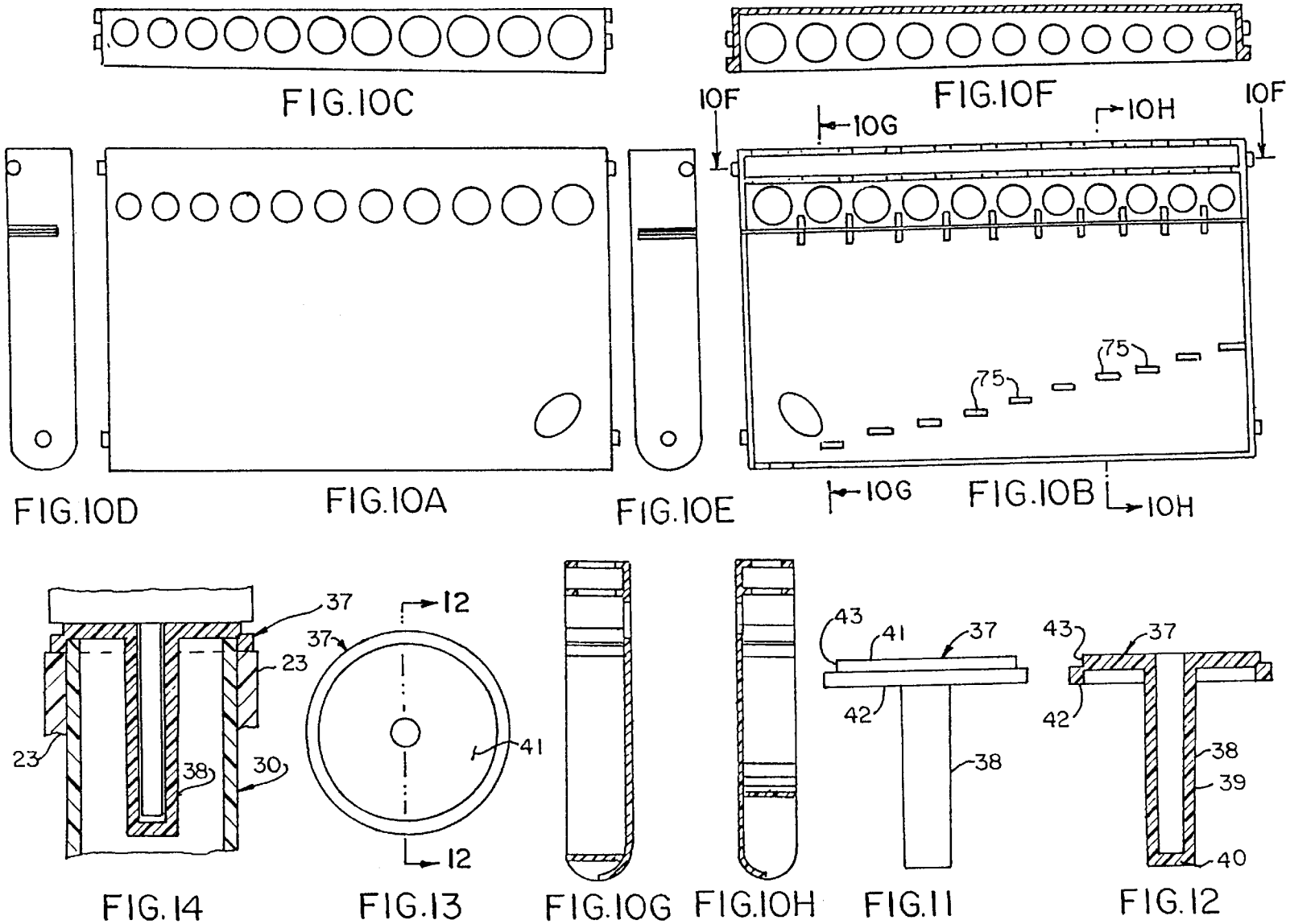
FIG. 10A is a view in rear elevation of the tray shown in FIG. 9A modified to receive larger bits.
FIG. 10B is a view in front elevation of a tray similar to the tray shown in FIG. 9B, but modified to receive larger bits.
FIG. 10C is a top plan view of the tray shown in FIG. 10A.
FIG. 10D is a view in end elevation of the tray shown in FIG. 10A.
FIG. 10E is a view in end elevation of the tray shown in FIG. 10B.
FIG. 10F is a sectional view taken along the line 10F—10F of FIG. 10D.
FIG. 10G is a sectional view taken along the line 10G—10G of FIG. 10D.
FIG. 10H is a sectional view taken along the line 10H—10H of FIG. 10D.
FIG. 11 is a view in side elevation of a hinge cap.
FIG. 12 is a sectional view of the cap shown in FIG. 11, taken along the line 12—12 of FIG. 13.
FIG. 13 is a top plan view of the cap shown in FIG. 11.
FIG. 14 is a fragmentary sectional view of the hinge cap in place in the tube of FIGS. 8E and 8F, with a sharpener mounted therein, as shown in FIGS. 1–4.

A cap 37, circular in plan, is shown in FIG. 13. The cap 37 has a circular top wall 41, with a rim 42, stepped outwardly from the top 41 to form a seat 43. The rim 42 extends over and engages tightly a projecting upper end of the tube 30. A stem 38 depends from the center of the top wall 41. The stem 38 has a passage in it defined by a side wall 39, which opens through the top 41 and is closed at the bottom by a bottom wall 40.

In this embodiment, the case leaves 3 and 4 are provided with slots 45 through which drills contained in the case can be observed. Key hole slots 46 are provided in the right leaf 4, to permit hanging of the case on a wall support.

A part of the wall 13 remote from the knuckles 23 has a latch finger 49 with an inwardly extending lip 50. The corresponding wall 14 of the right leaf has a stepped recess 51 into which the lip 50 snaps when the leaves are closed.

Figure 8C:
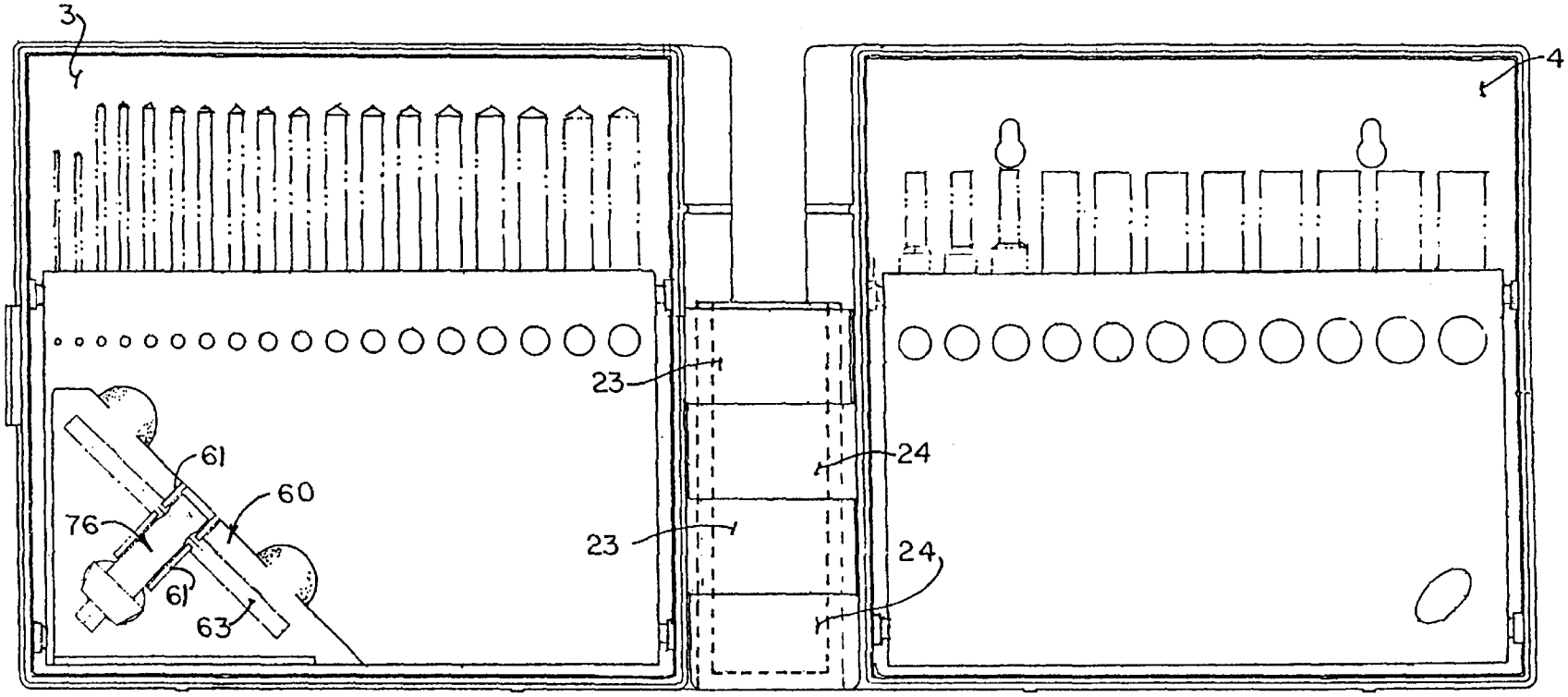
FIG. 8C is a view corresponding to FIG. 8A but with drill trays installed.
Figure 8D:
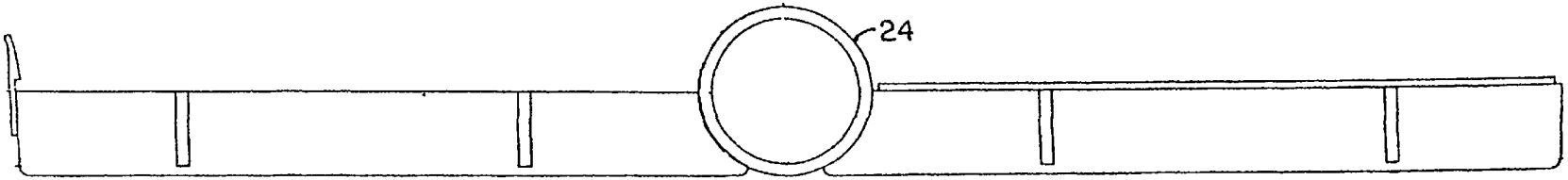
FIG. 8D is a plan view of the device shown in FIG. 8C.

A left drill-holding tray 53 is mounted in the left leaf 3, and a right drill-holding tray 54 is mounted in the right leaf 4. In the embodiment shown in FIGS. 8C and 9A, the tray 53, as shown in two embodiments in FIGS. 9A and 10A, has a back wall 56 curved at its lower edge on a radius of which a pivot stub 57 is the center, and sidewalls 58 from which both the stub shaft 57 and a stop 59 project. The stops 59 extend into channels, closed at the free end of the rims, defined by walls extending inwardly of the leaf rims, for limited movement outwardly away from the backwalls of the leaves 3 and 4. This permits limited rotational movement of the trays about the pivot stubs outwardly away from the back walls of the leaves 3 and 4, allowing the drills to move out from under the overhanging wall of the leaves, to permit their easy removal and replacement. In the embodiments shown in FIGS. 8C and 9A, the back wall has in it a series of holes corresponding in size to the drills to be mounted in the tray, and a formed chuck wrench seat 60. The chuck wrench seat 60 has a depressed triangular area from which parallel walls 61 extend. The walls 61 have a gap in them in which a cross bar 63 of a wrench 70 snaps to be seated and retain the wrench in place. In the embodiment shown in FIG. 9B, the right tray 54 has a complementarily depressed area, to accommodate the wrench. In the embodiment shown in FIG. 8*c*, only an opening in the tray is provided to accommodate the bevel gear of the wrench 70.

Preferably, each of the leaves has an upper wall and, spaced below it, an intermediate wall, both of which are provided with holes of a size to take a particular drill. Both leaves can also be provided with stepped or offset ledges 75 to accommodate drill bits of different lengths, so that they are more or less uniformly projected from the upper edge of the tray.

Referring now to FIGS. 1–7E, a drill sharpener 80 is shown as mounted in the tube 30, or, in this embodiment, more acurately, in the stem 38 of the cap 37 of the tube 30, and nested in a complementarily shaped portion of the spine of the case.

The sharpener 80 has a housing made up of two shell halves as indicated in FIGS. 7B, 7D, 7F and 7G. At one end of the assembled housing is an open collar 84, with a slot 85 in it opening through an outside edge of the collar. At the end of the housing opposite the collar 84, the housing has an opening in which a bearing-bushing member 87 is mounted. A spaced second bearing-bushing member 89 is mounted in an opening in an interior wall 90. A shaft 92 is journaled in the bushings 87 and 89, and projects from the housing 1 a substantial distance, as shown in FIGS. 5–7E.

Figure 7:
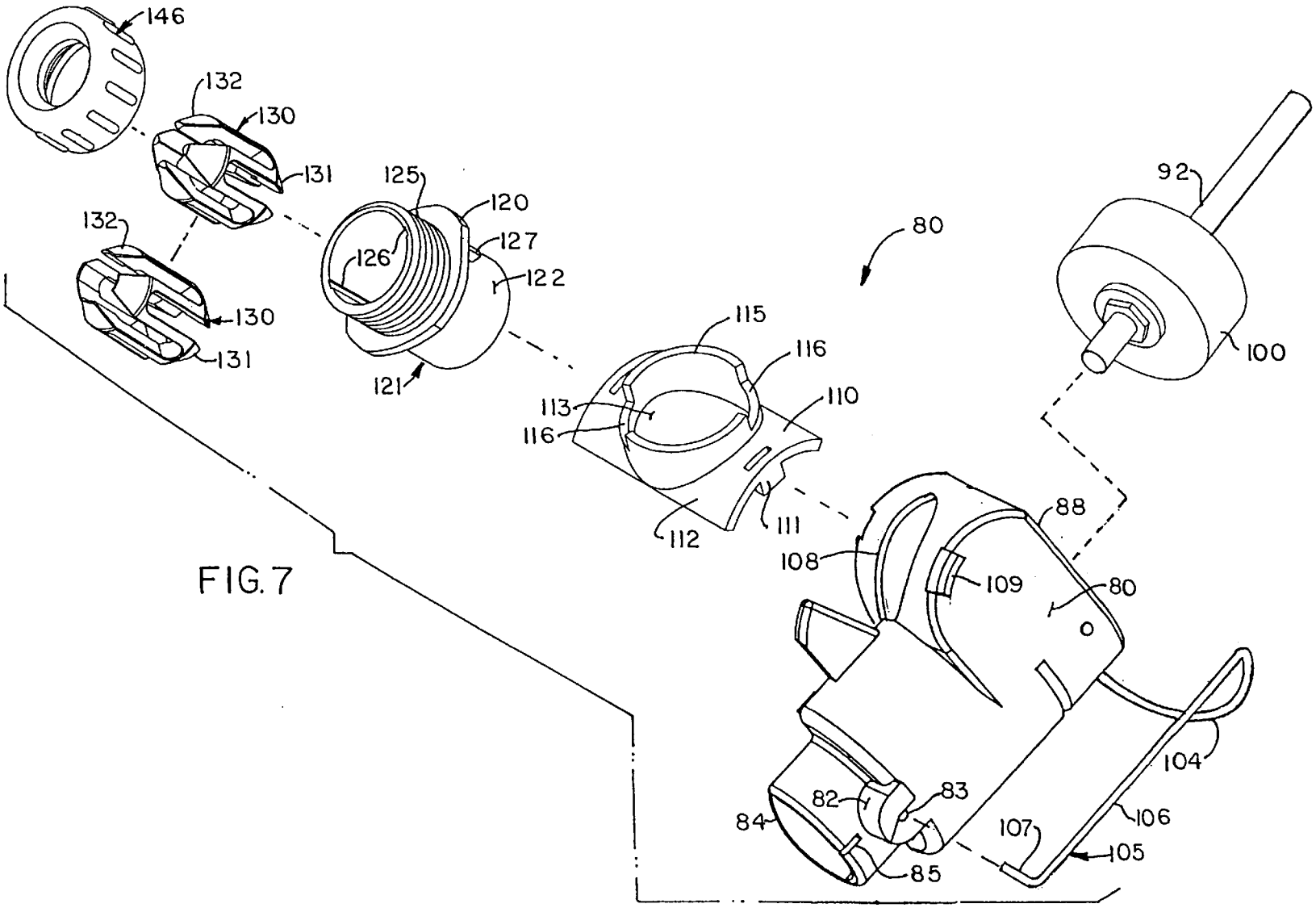
FIG. 7 is a exploded view of the sharpener shown in FIGS. 5 and 6 illustrating two sizes of collets.

When the sharpener 80 is mounted in the package 1, the shaft 92 extends into the stem 38 of the cap 37. The wall 88 rests on the top of the cap and defines with the seat 43 a channel into which an arcuate portion 104 of a wire stand 105 extends. The wire stand 105 has legs 106 extending from the arcuate part to a free end, at which the legs are bent inwardly to form pivots 107, as shown particularly in FIG. 7, seated in a hole 83 in a boss 82 on diametrically opposite sides of the housing, as indicated in FIGS. 7 and 2.

Figure 7A:
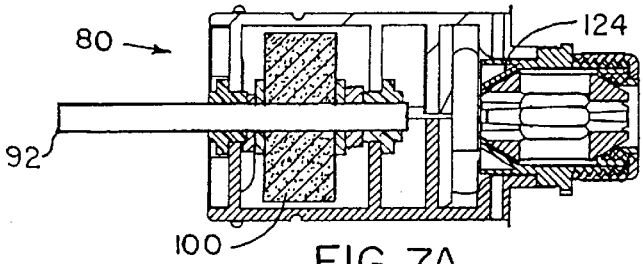
FIG. 7A is a longitudinal sectional view of the sharpener with a collet in a chuck mounted for storage in the housing of the sharpener.
Figure 7B:
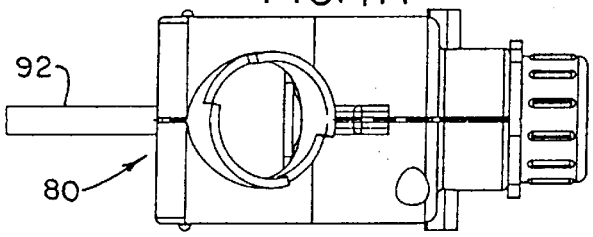
FIG. 7B is a top plan view of the sharpener as shown in FIG. 7A.
Figure 7F:
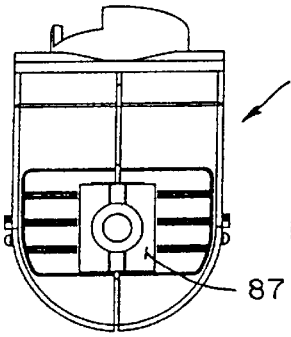
FIG. 7F is a view in end elevation viewed from left to right of FIG. 7A.
Figure 7C:
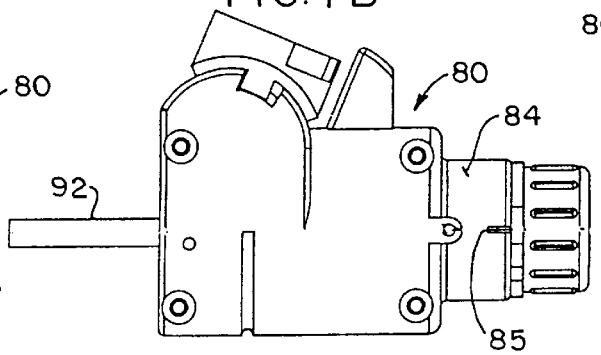
FIG. 7C is a view in side elevation of the sharpener shown in FIGS. 7A and 7B.
Figure 7G:
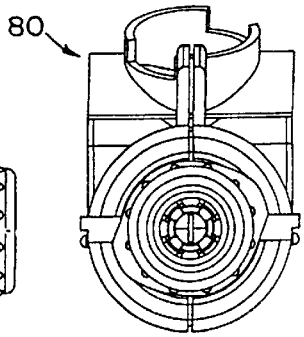
FIG. 7G is a view in end elevation viewed from right to left of FIGS. 7A–7E.
Figure 7D:
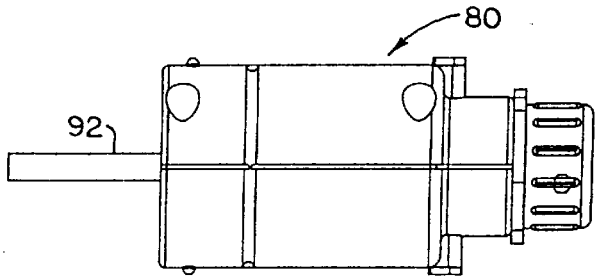
FIG. 7D is a bottom plan view of the sharpener.
Figure 7E:
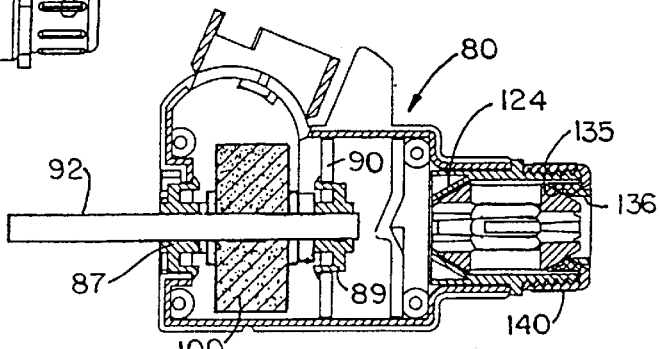
FIG. 7E is a longitudinal sectional view of the sharpener in side elevation.

The housing of the sharpener is rounded along one side to conform to the configuration of the spine of the case above the knuckles. On the diametrically opposite side, the housing is provided with an opening 108 flanked on either side by stepped notches 109 which accommodate tabs 111 on a collar assembly 110. The tabs 111 have inwardly extending lips, which snap into channels in the stepped notches 109, to retain the collar and at the same time permit some rotary movement of the collar, which has an arcuate body part 112 shaped complementarily to the contour of the housing 80 around the opening 108. The collar assembly 110 has an opening 113 defined by the inside surface of a collar 115. The collar 115 has cut out portions 116. A chuck assembly 120 includes an eared plate 121 a lower flat surface of which engages the upper edge surface of the collar 115 when the sharpener is in use, and a cylindrical skirt 122 which contains a frustro-conical wall 124 as shown particularly in FIGS. 7A and 7E, and a threaded cylindrical section 125 with a pair of diametrically opposite axially extending grooves 126 on its inside surface.

The chuck assembly is adapted to receive either of two sizes of collet 130. In this embodiment, the collet 130 is made of plastic that is flexible, and has camming surfaces 131 and 132 at either end. One of the camming surfaces engages the inner surface of the frustro-conical wall 124; the other of the cam surfaces engages a chamfered edge 135 on a wall 136 of a cap 140. The cap 140 is internally threaded, and has an inwardly extending rim from which the wall 136 depends, as shown clearly in FIGS. 7, 7A, and 7E. The cylindrical skirt 122 of the chuck assembly has a short rib 127 extending axially and projecting radially outwardly immediately below the eared plate 119. The rib 127, extending into the cut-out 116, permits movement of the cam assembly with respect to collar 115 within the limits imposed by the axially extending surfaces defining the cut-out.

In the package, the cam assembly 120, with a collet inside and the cap 140 in place, is slid into the collar 84, with the rib 127 extending into the slot 85, where it is held by friction fit.

Figure 6:
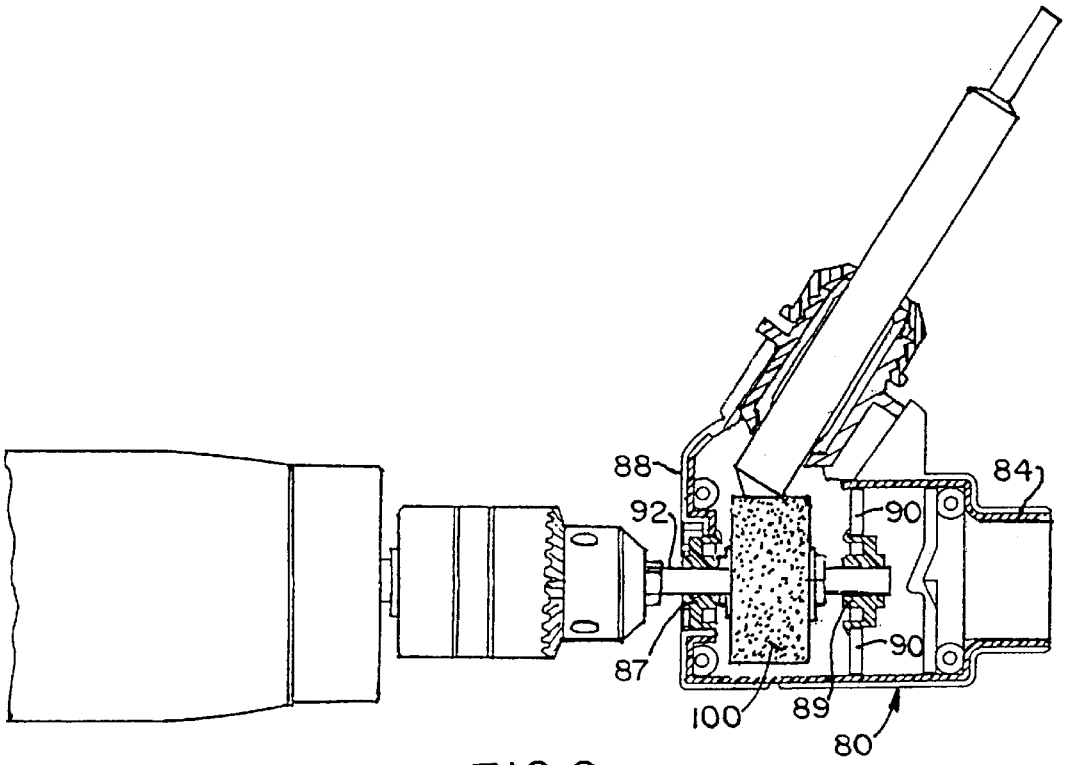
FIG. 6 is a view partly in section corresponding to FIG. 5, with a drill mounted in the drill sharpener for sharpening.

The operation of the sharpener is self evident from FIG. 6.

In the embodiment shown, all of the parts of the package except the grinding wheel, shaft and wire stand are molded of plastic. The collets and bushings are made of Nylon; the chuck assembly, and cap and sharpener housing, of ABS (acrylonitrile-butadiene-styrene), and the hinge cap, trays and case, of high impact polystyrene. However, those skilled in the art will recognize that other plastics may be employed, the characteristics of suitable plastics being well known in the molding art. The wire stand is made of 12 gauge steel wire, although, again, other materials and gauges can be used.

What is claimed is:

1. A drill bit and sharpener package comprising a case having two leaves pivotally mounted together along one edge by ring-shaped knuckles;

a tube mounted within the compass of said knuckles and serving as a pintle about which said knuckles rotate, and a drill bit sharpener removably and replaceably mounted in said tube.

2. The package of claim 1 including at least one drill-receiving tray mounted in one of said leaves.

3. The package of claim 2 wherein said tray has a pivot at a lower end for movement of said tray toward and away from a wall of said leaf.

4. The package of claim 2 wherein a tray has a chuck wrench seat in it.

5. The package of claim 3 wherein said tray has a stop spaced from said pivot and said leaf has a channel in which said stop is mounted for limited movement.

6. The package of claim 3 wherein both leaves have sidewalls extending around their perimeters, said walls of the two leaves facing each other when the leaves are closed and abutting around their perimeters.

7. The package of claim 6 wherein each of said leaves is formed of plastic in one piece, one of said leaf walls having a projecting arm with a lip at an outer end and the other of said leaf walls having a lip-receiving recess complementarily positioned to receive said lip.

8. The package of claim 1 wherein said drill bit sharpener has a housing with a cylindrical part nested in a complementarily shaped spine portion of said case.

9. The package of claim 8 wherein said drill bit sharpener has a shaft projecting from said drill bit sharpener housing in a direction axially within said tube.

10. The package of claim 9 wherein said drill bit sharpener housing has an opening at a part remote from said tube, in which a chuck is mounted, and a collet is mounted inside said chuck.

11. The package of claim 9 wherein a hinge cap is mounted in an open end of said tube, said hinge cap having a depending stem with a blind bore opening at its upper end for receiving said shaft.

12. The package of claim 9 including a wire stand member having an arcuate section extending into a space between said cap and a body of said sharpener housing, and a pair of legs extending from said arcuate section axially of said housing and pivotally mounted to said housing at ends remote from said arcuate section when said sharpener is mounted in said tube, said arcuate section being rotatable to a position at which it supports an end of said sharpener housing when said shaft is connected to an electric drill when the sharpener is demounted from the package.

13. The package of claim 10 wherein said sharpener has a grinding wheel mounted on said shaft and an opening defined by an inside surface of a collar at an angle to the axis of rotation of said shaft in which said collet can be mounted to hold a drill to be sharpened.

* * * * *